United States Patent [19]

Weeks

[11] Patent Number: 4,489,781

[45] Date of Patent: Dec. 25, 1984

[54] SETTING TOOL AND RIGHT-HAND SET MECHANICAL LINER HANGER

[76] Inventor: Benjamin R. Weeks, 3720 Country Estates, Corpus Christi, Tex. 78410

[21] Appl. No.: 507,889

[22] Filed: Jun. 27, 1983

Related U.S. Application Data

[63] Continuation-in-part of Ser. No. 465,738, Feb. 11, 1983.

[51] Int. Cl.[3] ..... E21B 23/00

[52] U.S. Cl. ..... 166/208; 166/216; 166/217

[58] Field of Search ..... 166/208, 210, 213, 216, 166/217, 206, 138, 139, 240, 117.7, 124

[56] References Cited

U.S. PATENT DOCUMENTS

| | | | |
|---|---|---|---|
| 1,892,442 | 12/1932 | Wickersham | 166/216 |
| 3,136,367 | 6/1964 | Wright et al. | 166/124 |
| 3,171,490 | 3/1965 | States | 166/139 |
| 3,171,491 | 3/1965 | States | 166/139 |
| 3,223,170 | 12/1965 | Mott | 166/217 |

*Primary Examiner*—James A. Leppink

*Assistant Examiner*—Hoang C. Dang

*Attorney, Agent, or Firm*—Fulbright & Jaworski

[57] ABSTRACT

A setting tool for setting a well tool, such as a mechanical liner hanger, inside of a well conduit by right-hand or clockwise rotation. A setting tool supports a well tool by a running nut having left-handed external threads and includes a setting nut for setting the well tool. Both nuts are positioned on an elongate member which includes an out-of-round external contour for rotating each of said nuts and includes a round contour for selectively rotating only the supporting nut for disengaging the tool by right-hand rotation after setting the well tool. An improved right-hand set mechanical liner includes internal threads for supporting the mandrel from a setting tool and includes one or more upwardly extending notches for receiving and being rotatively set by setting tool. A liner hanger includes a mandrel with two lugs moving against a downwardly directed surface of a cage for moving slips upwardly onto a cone on the mandrel and expanding the slips into a setting engagement with the well tool.

5 Claims, 8 Drawing Figures

50
68
66
10
20
22
24
25
32
30
34
12
36
46
26
14
40
38
26a
44
42
18

76

52
70
74
50
72
64
6
6
66
58
56
54
60
10
22
25
30
32

Fig. 5
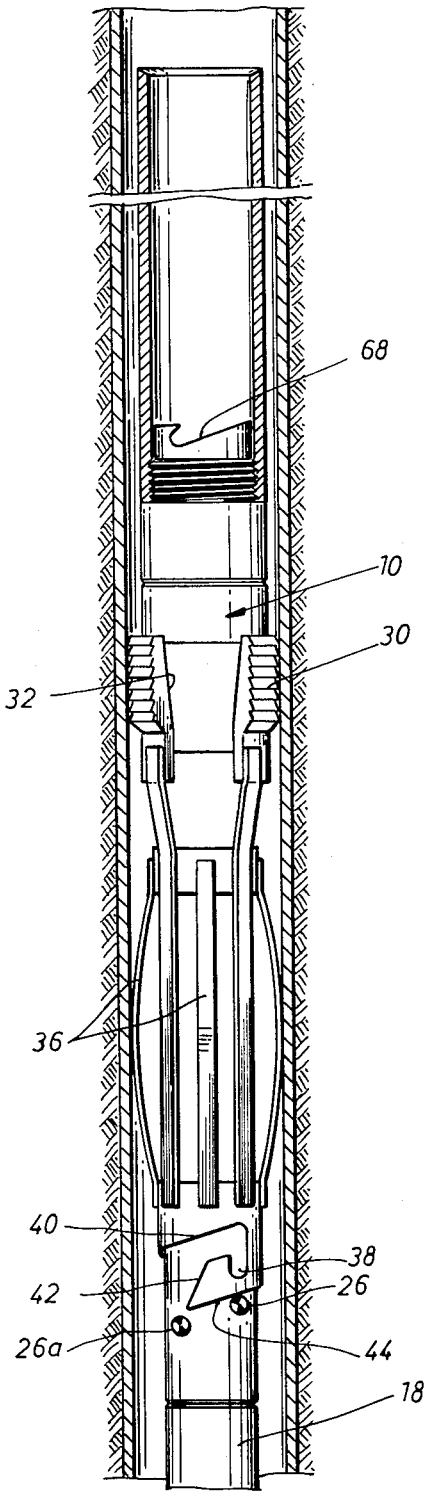
Fig. 6
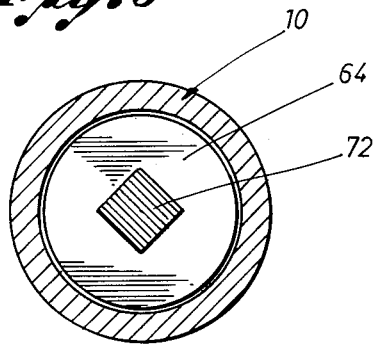
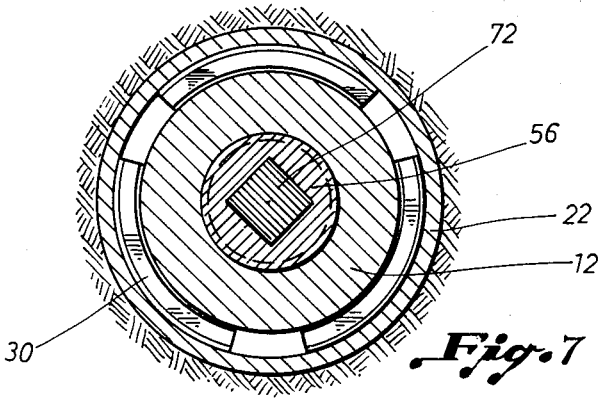
Fig. 7
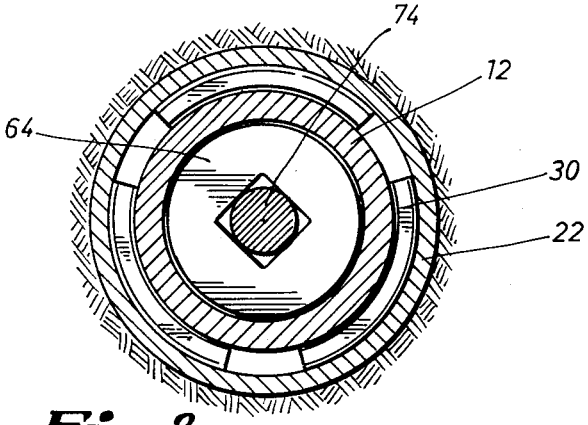
Fig. 8

SETTING TOOL AND RIGHT-HAND SET MECHANICAL LINER HANGER

CROSS-REFERENCE TO RELATED APPLICATION

This application is a continuation in part of my co-pending Patent Application, Ser. No. 465,738, filed Feb. 11, 1983.

BACKGROUND OF THE INVENTION

My prior co-pending patent application discloses a mechanical liner hanger which is set inside of a well conduit by right-hand or clockwise rotation and in which the liner may be easily released and/or recocked and reset to a different location. The present invention is directed to improvements to that liner hanger. In addition, the present invention is directed to a setting tool, which while particularly applicable to setting the liner hanger of the present invention, is also suitable for setting other well tools in a well conduit. The setting tool of the present invention will provide a supporting action and setting action for a well tool, all with a right-hand drive, thereby avoiding any undesirable left-hand rotation in a well.

SUMMARY

The present invention is directed to a right-hand setting tool for setting a right-hand set well tool in a well. The setting tool includes an elongate member having a supporting shoulder thereon with a running nut slidably mounted on the elongate member above the supporting shoulder. The nut includes left-handed external threads for a mating with internal running threads on a well tool for supporting the well tool from the supporting shoulder. The nut includes an out-of-round internal contour for being driven in a rotative direction by the elongate member. A setting nut is slidably mounted on the elongate member above the running nut. The setting nut includes coacting engaging means for engaging a well tool for setting the well tool. The setting nut includes an out-of-round internal contour for being driven in a rotative direction by the elongate member. A spacing shoulder is positioned on the elongate member above the setting nut. The elongate member includes an out-of-round external contour adjacent to and above the supporting shoulder for rotating the setting nut for setting a well tool. The elongate member also includes a round contour above the out-of-round contour. After setting the well tool, the elongate member can be lowered to bring the round contour into registry with the setting nut when the spacing shoulder engages the setting nut. At this time the out-of-round portion of the elongate member engages the running nut,. Further right-hand rotation of the well tool will disengage the running nut from the well tool.

A further object of the present invention is wherein the setting nut includes one or more radially extending lugs for engaging upwardly extending notches in the well tool.

And still a further object of the present invention is wherein the lower surface of the spacing shoulder includes bearings whereby rotation of the spacing shoulder against the setting nut avoids rotation of the setting nut.

Still a further object of the present invention is the provision of a right-hand set mechanical liner hanger for engaging the inside of a well conduit which includes a mandrel having an annular wedge cone around the outer circumference of the mandrel, the mandrel having internal running threads for supporting the mandrel from a setting tool, said threads being released by right-hand rotation of the setting tool, and said mandrel having one or more upwardly extending notches for engaging a coacting, right-hand rotative setting tool. A lug is connected to the outside of the mandrel below the cone and a cage is telescopically and rotatively movable on the mandrel between the cone and the lug. The cage includes (1) a plurality of slips extending upwardly and adapted to move upwardly onto the cone and outwardly into a set position for engaging a well tool, (2) a plurality of bow springs extending outwardly for engaging a well conduit for allowing longitudinal and rotative movement of the cage relative to the mandrel, (3) an upwardly directed opening for engagement by the lug, whereby the cage can be moved downwardly in a well conduit with the mandrel, while preventing the slips from setting, and (4) the clockwise, downwardly extending and downwardly directed surface extending from above the opening to past the bottom of the opening, whereby an upward movement of the mandrel would move the lug out of the opening onto the downwardly directed surface and right-hand rotation of the mandrel will move the slips upwardly onto the cone for setting.

Yet a further object of the present invention is wherein the liner hanger includes a second lug connected to the outside of the mandrel below the cone with the second lug being positioned to engage the downwardly directed spiral surface when the first lug engages the surface.

Still a further object of the present invention is wherein the upwardly extending notches in the liner hanger are directed so that right-hand rotation of a setting tool will engage and drive said notches, but a left-hand rotation will not engage and drive the hanger in a left-hand direction.

Other and further objects, features and advantages will be apparent from the following description of a presently preferred embodiment of the invention, given for the purpose of disclosure and taken in conjunction with the accompanying drawings.

BRIEF DESCRIPTION OF THE DRAWINGS

FIG. 5 is a fragmentary elevational view illustrating the set liner hanger of the present invention in a well casing, FIG. 6 of the cross-sectional view taken along the line 6—6 of FIG. 2, FIG. 7 is a cross-sectional view taken along the line 7—7 of FIG. 3, and FIG. 8 is a cross-sectional view taken along the line 8—8 of FIG. 4.

DESCRIPTION OF THE PREFERRED EMBODIMENT

Figure 1:
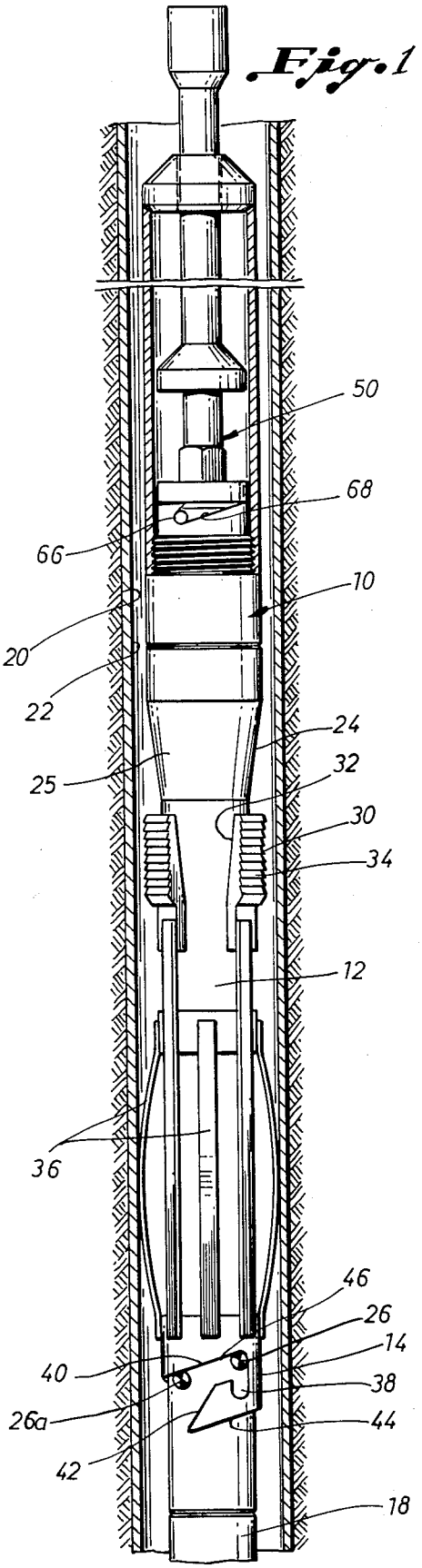
FIG. 1 is a fragmentary elevational view illustrating the setting tool and improved liner hanger of the present invention in a well casing in an intermediate setting position.

Referring now to the drawings, the reference numeral 10 generally indicates the right-hand set mechanical liner hanger of the present invention and generally includes a mandrel 12 and a cage assembly 14.

The mandrel 12 generally includes a threaded connection to a conventional liner 18 at the bottom, which is to be hung or supported from a well conduit such as a casing 20 positioned in a well 22. The mandrel also includes an annular wedge cone 24, which is fixedly secured to the mandrel 12 and a lug or pin 26 connected to the outside of the mandrel 12 below the cone 24.

The cage assembly 14, which is telescopically and rotatively slidable on the mandrel 12 between the cone 24 and the lug 26, includes a plurality of slips 30, having an interior wedge surface 32 and a plurality of horizontally extending teeth 34 on the outside. The slips 30 are adapted to be moved upwardly onto the wedge surface 25 of the cone 24 and outwardly into an engaging position with the interior of the casing 20 into a set position. The teeth 34 on the outside of the slips 30 engage and grip the casing 20. The cage assembly 14 also includes a plurality of bow springs 36 which extend outwardly and engage the interior of the casing 20 for allowing longitudinal and rotational movement of the cage 14 relative to the mandrel 12.

The cage 14 includes an upwardly directed opening 38 for engagement by the lug 26 or whereby the cage 14 may be moved downwardly with the mandrel 12 inside of the casing 20 while preventing the slips 30 from engaging the cone 24 and setting. The cage also includes a clockwise, downwardly extending and downwardly directed spiral surface 40 extending from above the opening 38 in a generally helical path, at an angle of approximately 15 degrees, past the bottom of the opening 38 whereby an upward movement of the mandrel 12 will move the lug 26 out of the opening 38 and onto the downwardly directed surface 40. Thereafter, a right-hand rotation of the mandrel 12 will move the cage 14 and the slips 24 upwardly. The vertical lead or extent of the downwardly directed surface 40 is sufficient so that rotation of the lug 26 and consequent upward movement of the cage 14 will move the slips 30 onto the cone 24 for setting. Preferably, the rotational extent of the downwardly directed surface 40 is greater than 360 degrees. In addition, a passageway 42 is provided extending between the lower extent 44 of the surface 40 and the upper extent 46 of the surface 40 for allowing the hanger 10 to be released and/or recocked.

The above description of the liner hanger is generally described in my co-pending patent application, Ser. No. 465,738. It is to be noted that in the setting operation, the hanger 10 has been manipulated solely by vertical or right-hand rotation, as left-hand rotation is an undesirable movement in a well wherein the connected joints are made up of right-handed treads.

One improvement to the liner hanger or the present invention is the provision of a second lug **26*a* connected to the mandrel 12. The lug 26*a* is spaced from the lug 26 so as not to interfere with the operation of the lug 26 relative to the opening 38. In addition, the lug 26 engages the downwardly directed surface 40 when the lug 26 engages the surface 40, as best seen in FIG. 1. Therefore, the additional lug 26*a* carries half of any shock load and in the event that one of the lugs is sheared inadvertently, the second lug can still operate the liner hanger 10**.

While the liner hanger 10 may be set in place by various types of setting tools, the present invention also includes a right-hand actuated setting tool, generally indicated by the reference numeral 50 which is particularly useful for supporting and setting various types of oil tools, and particularly a liner hanger such as 10.

Figure 2:
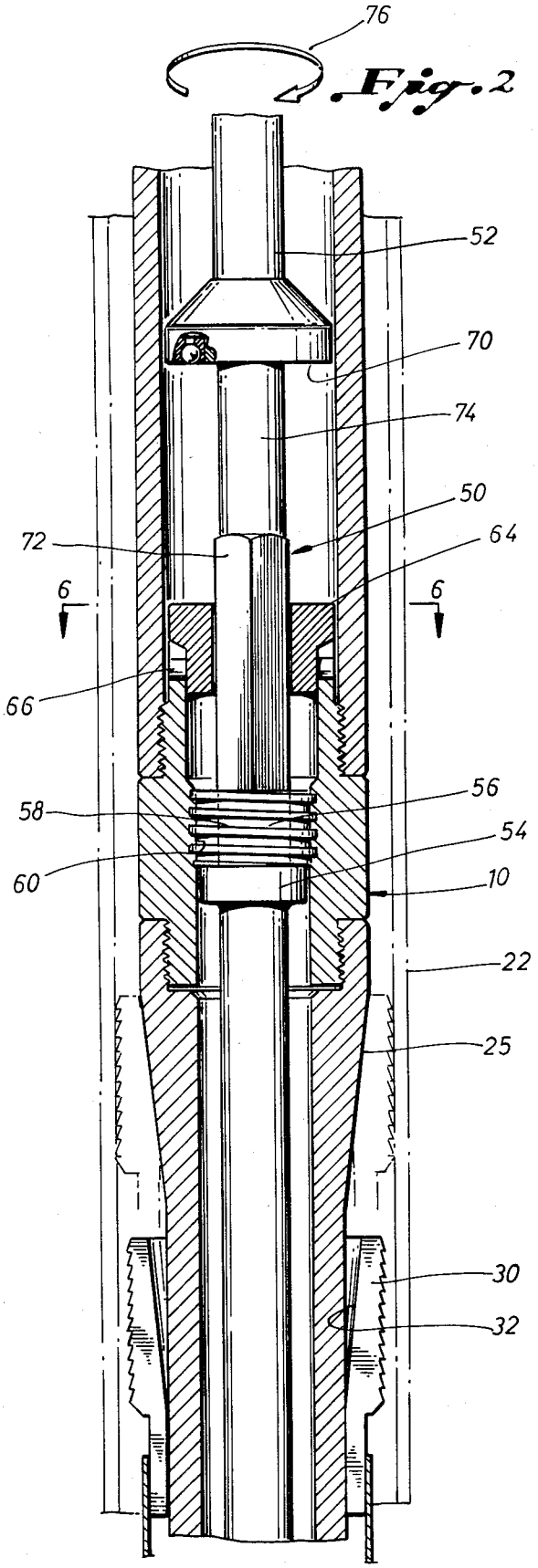
FIG. 2 is an enlarged fragmentary elevational view, in cross-section, of the setting tool being rotated to set the liner hanger.

Referring to the drawings and particularly to FIGS. 1 and 2, the setting tool 50 generally includes an elongate member 52 having a supporting shoulder 54 connected thereto. A running nut 56 is slidably mounted on the elongate member 52 above the supporting shoulder 54. The nut 56 includes left-handed threads 58 for mating with internal running threads 60 on the interior of the liner hanger 10. Thus, when the running nut is threadably engaged by left-hand rotation into the liner hanger 10, the liner hanger is supported on the supporting shoulder 54, and the setting tool 50 may move the liner hanger 10 down a well through the casing 22 to the proper location at which the liner hanger 10 is to be set. The running nut 56 includes an out-of-round internal contour 72, preferably square for being rotated by the elongate member 52.

A setting nut 64 is slidably mounted on the elongate member 52 and positioned above the running nut 56. The setting nut 64 includes coacting engaging means for engaging the well tool such as the liner hanger 10. For example, the setting nut 64 may include one or more radially extending lugs 66 coacting with and engaging upwardly extending notches 68 on the liner hanger 10. The setting nut 64 includes an out-of-round internal contour, preferably square, for being driven in a rotative direction by the elongate member 52. Thus, when the setting nut 64 is rotated to the right, the mandrel 12 of the liner hanger 10 is rotated to move the lugs 26 and 26A (FIG. 1) clockwise, relative to the downwardly directed surface 40. This causes the cage 14 to move upwardly and causes the slips 30 to move from the retracted position, shown in solid outline in FIG. 2, and to move upwardly whereby the slips 30 move on to the wedge surface 25 of the cone 24, as shown in the dotted outline in FIG. 2. This causes the teeth 34 on the backside of the slips 30 to engage and bite into the interior of the casing 20.

A spacing shoulder 70 is provided connected to the elongate member 52 above the setting nut 64. The elongate member 52 includes an out-of-round external contour 72, preferably square, and further includes a round contour 74 above the square contour 70, for selectively rotating the running nut 56 and the setting nut 64. That is, as shown in FIG. 2, with the elongate member 52 being rotated in a clockwise direction, as indicated by the arrow 76, the square section 72 rotates the setting nut 64 to set the liner hanger 10 as described. However, at the same time, the running nut 56 is rotated, but is not effected, since the liner hanger 10 is simultaneously rotated.

Figure 3:
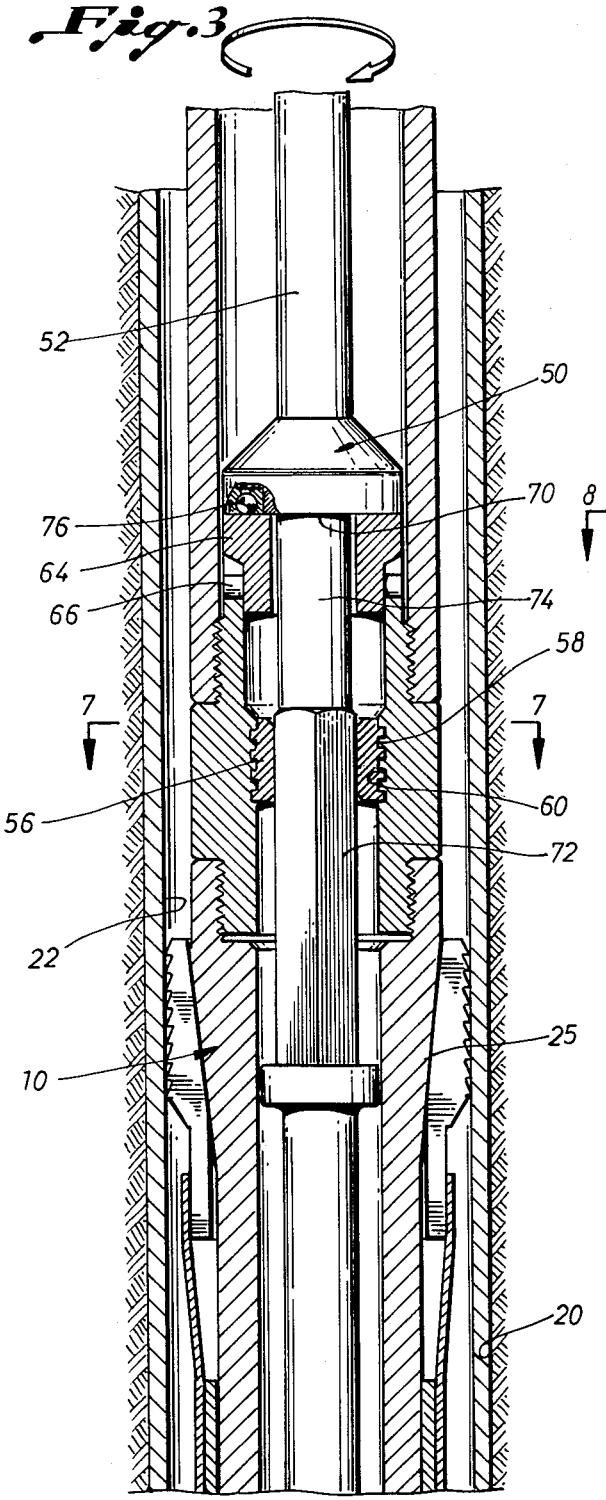
FIG. 3 is a view similar to FIG. 2 with the liner set and with setting tool in position for being released from the set liner hanger.
Figure 4:
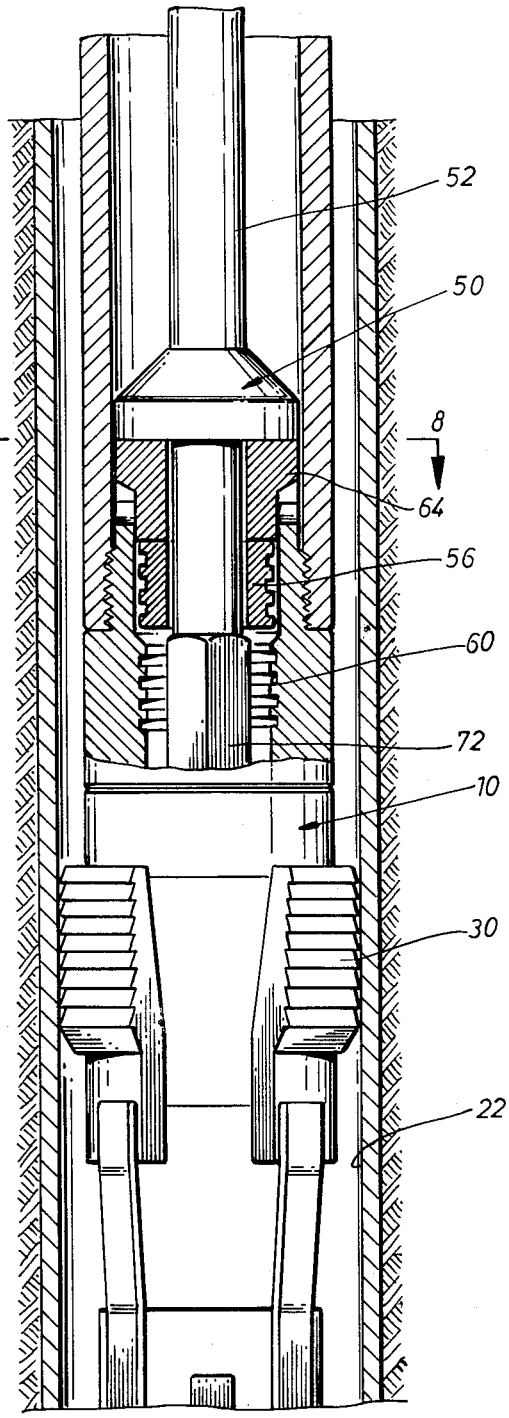
FIG. 4 is a fragmentary elevational view, partly in cross section, of the setting tool released from the set liner hanger.

After the liner hanger is set, the setting tool 50 may then be disconnected from the liner hanger 10 and removed. Referring now to FIG. 3, after the liner hanger 10 has been set in the casing 22, the setting tool 50 is lowered until the spacing shoulder 70 contacts the setting nut 64. In this position, the square portion of 72 of the elongate member 52 is in registry with the running nut 56, but the round section 74 of the elongate member 52 is in registry with the setting nut 64. Therefore, continued right-hand rotation of the setting tool 50 has no further effect on the setting nut 64. In fact, it is preferable to use a bearing surface, such as bearings 76 in the shoulder 70 to avoid any further rotation of the nut 64 and liner hanger 10. However, further right-hand rotation of the elongate member 52 will drive the supporting nut 56 in a right-hand rotation and disconnect the coacting threads 58 and 60. And thus, as best seen in FIG. 4, the supporting nut 56 has been rotated out of engagement with the liner hanger 10 and the setting tool 50 may be lifted up and retrieved. The supporting shoulder 54 will carry the nuts 56 and 64 and the radially extending lug 66 will readily disengage from the upwardly extending notches 68 in the liner hanger 10.

As best seen in FIG. 5, the removal of setting tool 50 will leave the liner hanger 10 in a set position in the casing 22, with the slips 30 holding the casing hanger 10 in any liner 18 therebelow.

Referring now to FIGS. 1 and 5, it is to be particularly noted that the notch or notches 68 in the upper end of the liner hanger 10 are directed preferably in a counterclockwise direction so that right-hand rotation of the setting tool 50 will engage and drive the notches 68, but a left-hand rotation will not engage and drive the liner hanger in a left-handed direction. This further insures that the hanger 10 cannot be accidentally rotated in a direction to release from the running nut 56.

The present invention, therefore, is well adapted to carry out the objects and attain the ends and advantages mentioned as well as others inherent therein. While a presently preferred embodiment of the invention is given for the purpose of disclosure, numerous changes in the details of construction and arrangement of parts will readily suggest themselves to those skilled in the art and which are encompassed within the spirit of the invention and the scope of the appended claims.

What is claimed is:

1. A right-hand setting tool for setting a right-hand set well tool in a well comprising, an elongate member having a supporting shoulder thereon, a running nut slidably mounted on the elongate member above the supporting shoulder, said nut including left-handed external threads for mating with internal running threads on a well tool for supporting said well tool from the supporting shoulder, said nut including an out of round internal contour for being driven in a rotative direction by the elongate member, a setting nut slidably mounted on the elongate member above the running nut, said setting nut including coacting engaging means for engaging a well tool for setting the well tool, said setting nut including an out of round internal contour for being driven in a rotative direction by the elongate member, a spacing shoulder on said elongate member above the setting nut, said elongate member having an out of round external contour adjacent to and above the supporting shoulder for rotating said setting nut for setting the well tool and said elongate member having a round contour above the out of round contour whereby after setting the well tool the elongate member can be lowered to bring the round contour into registry with the setting nut when the spacing shoulder engages the setting nut whereby further right-hand rotation will disengage the running nut from the well tool, a right-hand mechanical liner hanger for engaging the inside of a well conduit and adapted to be set by the setting tool comprising, a mandrel having an annular wedge cone around the outer circumference of the mandrel, said mandrel having internal running threads for coacting with the threads on the running nut, said mandrel having one or more upwardly extending notches for engaging the coacting engaging means of the setting nut, a lug connected to the outside of the mandrel below the cone, a cage telescopically and rotationally movable on the mandrel between the cone and said lug, said cage including, a plurality of slips extending upwardly adapted to move upwardly onto the cone and outwardly to a set position for engaging a well conduit, a plurality of bow springs extending outwardly for engaging a well conduit for allowing longitudinal and rotational movement of the cage relative to the mandrel, said cage including an upwardly directed opening for engagement by the lug whereby the cage can be moved downwardly in a well conduit with the mandrel while preventing the slips from setting, said cage including a clockwise downwardly extending and downwardly directed spiral surface extending from above the opening to past the bottom of the opening whereby an upward movement of the mandrel will move the lug out of the opening onto the downwardly directed surface and right-hand rotation of the mandrel will move the slips upwardly onto the cone for setting.

2. The apparatus of claim 1 including a second lug connected to the outside of the mandrel below the cone, said second lug being positioned to engage the downwardly directed spiral surface when the first lug engages said surface.

3. A right-hand set mechanical liner hanger for engaging the inside of a well conduit comprising, a mandrel having an annular wedge cone around the outer circumference of the mandrel, said mandrel having internal running threads for supporting said mandrel from a setting tool, said threads being releasable by right-hand rotation of the setting tool, said mandrel having one or more upwardly extending notches for engaging coacting right-hand rotative setting, a lug connected to the outside of the mandrel below the cone, a cage telescopically and rotationally movable on the mandrel between the cone and said lug, said cage including, a plurality of slips extending upwardly adapted to move upwardly onto the cone and outwardly to a set position for engaging a well conduit, a plurality of bow springs extending outwardly for engaging a well conduit for allowing longitudinal and rotational movement of the cage relative to the mandrel, said cage including an upwardly directed opening for engagement by the lug whereby the cage can be moved downwardly in a well conduit with the mandrel while preventing the slips from setting, said cage including a clockwise downwardly extending and downwardly directed spiral surface extending from above the opening to past the bottom of the opening whereby an upward movement of the mandrel will move the lug out of the opening onto the downwardly directed surface and right-hand rotation of the mandrel will move the slips upwardly onto the cone for setting.

4. The apparatus of claim 3 including a second lug connected to the outside of the mandrel below the cone, said second lug being positioned to engage the downwardly directed spiral surface when the first lug engages said surface.

5. The apparatus of claim 3 wherein the upwardly extending notches are directed so that right-hand rotation of a setting tool will engage and drive said notches, but a left-hand rotation will not engage and drive the hanger in a left-hand direction.

* * * * *